US010117458B2

(12) United States Patent
Fekete

(10) Patent No.: US 10,117,458 B2
(45) Date of Patent: Nov. 6, 2018

(54) AUTOMATIC SELF-CLEANING CIGAR PUNCH

(71) Applicant: Ronald Fekete, Sanborn, NY (US)

(72) Inventor: Ronald Fekete, Sanborn, NY (US)

( * ) Notice: Subject to any disclaimer, the term of this patent is extended or adjusted under 35 U.S.C. 154(b) by 679 days.

(21) Appl. No.: 14/807,565

(22) Filed: Jul. 23, 2015

(65) Prior Publication Data

US 2017/0020189 A1 Jan. 26, 2017

(51) Int. Cl.
*A24F 13/26* (2006.01)

(52) U.S. Cl.
CPC ..... *A24F 13/26* (2013.01)

(58) Field of Classification Search
CPC ..... A24F 13/00; A24F 13/26; A24C 1/386
USPC ..... 30/109, 111; 131/248, 254, 255, 250, 131/252, 253; 83/30, 123, 128, 685, 931
See application file for complete search history.

(56) References Cited

U.S. PATENT DOCUMENTS

| | | | | |
|---|---|---|---|---|
| 5,771,581 | A * | 6/1998 | Smith | A24F 13/26 131/255 |
| 5,799,662 | A | 9/1998 | Conte | |
| 5,862,808 | A | 1/1999 | Albarello | |
| 6,341,610 | B1 * | 1/2002 | Chuan | A24F 13/26 131/248 |
| 8,720,449 | B2 | 5/2014 | Dipple | |
| 2011/0146696 | A1 | 6/2011 | Dipple | |

* cited by examiner

*Primary Examiner* — Michael H. Wilson
*Assistant Examiner* — Dionne W. Mayes

(57) ABSTRACT

A cigar punch is designed to cut out plug from the sealed end of a cigar and automatically expel the plug out of the punch.

19 Claims, 5 Drawing Sheets

AUTOMATIC SELF-CLEANING CIGAR PUNCH

FIELD OF THE INVENTION

The present invention relates generally to preparing cigars for smoking and, more particularly, concerns a cigar punch to cut out a plug from the sealed end of a cigar and automatically expel the plug out of the punch.

BACKGROUND OF THE INVENTION

Cigars have long been popular. Most cigar smokers consider a fine cigar an investment in their enjoyment that is exemplified by numerous cigar shops and cigar lounges established nationwide. Fine quality cigars are manufactured with only one cut end, which is the end that the cigar smoker lights. To preserve freshness of the cigar, the cigar manufacturers normally close or seal the opposite end, also called the smoking end, of the cigar. However, the sealed end must be cut before a cigar can be smoked, to enable the cigar smoker to draw smoke through the cigar. Opening the sealed end of a cigar is somewhat problematic.

Before the advent of cigar punches and cutters, the conventional method of opening the sealed end of a cigar had been to cut off the entire sealed end of the cigar with a sharp blade or knife, or biting off a portion of the end of the cigar intended to be placed in the mouth. Some cigar smokers still use these methods for opening the sealed end of a cigar. Both of these methods would usually result in the sealed end of a cigar that is to be placed in the mouth becoming tattered and frayed, leaving the cigar smoker with bits of tobacco in his mouth or lips and thus risking possible ingestion of tobacco. These conventional methods lessen the enjoyment and pleasure of smoking a cigar because of the frayed sealed end of the cigar and are for that reason, among others, unacceptable to the connoisseur of fine cigars.

Many cigar punches have been invented to remedy the above-mentioned deficiency. These cigar punches cut out a plug from the sealed end of a cigar and leave the remaining portion of the cigar-cap intact that prevents fraying of the cigar wrapper and avoids bits of tobacco from entering the mouth of a cigar smoker. Some connoisseurs of fine cigars also contend that properly punching the sealed end of a cigar lends itself to a more intense flavor and can help prolong the experience of smoking the cigar by tightening the draw. Additionally, punching the end of a cigar also results in a cooler smoke by preventing overheating through drawing in too much air. For these reasons, among others, connoisseurs of fine cigars prefer using a cigar punch for preparing a cigar for smoking instead of the conventional methods of biting or cutting off the sealed end of a cigar.

Conventional cigar punches generally comprise a plunger having a cutting edge or a blade end that is seated within a housing, wherein the plunger is pushed outwardly to extend out of the housing thereby, exposing the cutting edge or blade end that is then inserted into the sealed end of a cigar and twisted to sever and extract a plug from the sealed end of the cigar. In these conventional cigar punches, the plunger is pushed or extended out of its housing to expose the cutting edge or blade end, thus posing a higher health and safety risk for a person in possession of these cigar punches because of the likelihood of accidentally pushing the plunger. Inadvertently pushing a plunger having a cutting edge or a blade end, for example when a conventional cigar punch is in a user's pocket, will expose the cutting edge or the blade end that can be potentially injurious to the user. Further, the cutting edge or blade end of these conventional cigar punches are likely to get easily deformed and blunted upon impact due to uniform thinness of their side surface and absence of any support in their hollow core. Dull cigar punches need to be sharpened or changed time and again because a dull cigar punch can damage a cigar being punched and can decrease the enjoyment of smoking the cigar. Yet further, in many conventional cigar punches, a plug that is cut and removed from the sealed end of a cigar remains within the cigar punch and has to be ejected manually to clean the cigar punch.

In order to overcome the above-mentioned deficiencies of conventional cigar punches, there is an unmet need for an improved cigar punch.

SUMMARY OF THE INVENTION

The present invention generally relate to a cigar punch for cutting plug of a cigar. The invention is directed to a self-cleaning cigar punch that resembles a fully-loaded .308 Winchester caliber bullet. Unlike other bullet-shaped cigar punches, the present invention has a spring soldered inside a casing that enables self-cleaning and further allows the cigar punch to remain in one piece during use.

The details of additional embodiments of the invention are set forth in the description below. Other features and advantages of the invention will be apparent from the detailed description, the accompanying drawings, and from the claims.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, may best be understood by reference to the detailed description that follows taken in conjunction with the accompanying drawings.

DETAILED DESCRIPTION OF THE INVENTION

I. General

Figure 1:
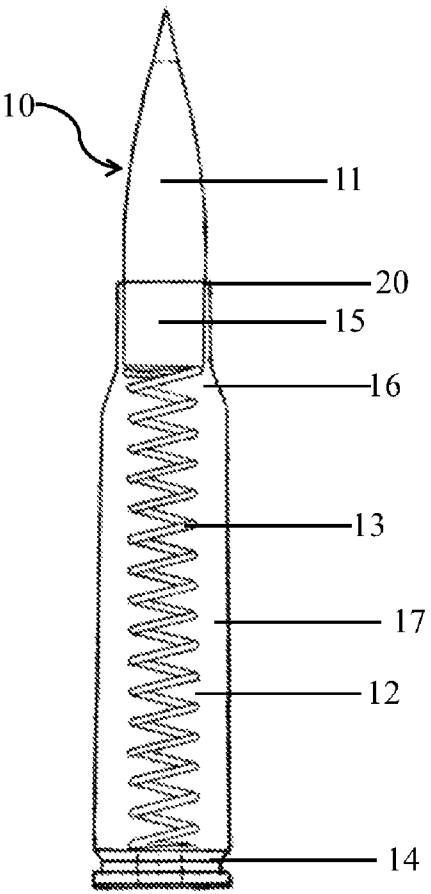
FIG. 1 is a simplified view of an embodiment of a self-cleaning cigar punch in accordance with the present invention illustrating a casing attached to a cylindrical piston.

The present invention relates generally to preparing cigars for smoking and, more particularly, concerns a cigar punch to cut out a plug from the sealed end of a cigar and automatically expel the plug out of the punch. In many conventional cigar punches, a plug that is cut and removed from the sealed end of a cigar remains within the cigar punch and has to be ejected manually to clean the cigar punch. In these conventional cigar punches, the plunger is pushed or extended out of its housing to expose the cutting edge or blade end, thus posing a higher health and safety risk for a person in possession of these cigar punches because of the likelihood of accidentally pushing the plunger.

The self-cleaning cigar punch of the present invention is intended to remedy these deficiencies.

II. Automatic Self-Cleaning Cigar Punch

The following description is meant to be exemplary of certain embodiments of the present invention. It should be understood that many other embodiments and variations thereof are also contemplated in the spirit and scope of the present invention.

In describing various embodiments of the present invention, reference will be made herein to FIGS. 1-5 of the drawings in which like numerals refer to like features of the invention. Features of the invention are not necessarily shown to scale in the drawings.

With reference now to the figures, and in particular to FIG. 1, a simplified cigar punch 10 is illustrated in accordance with the present invention. The cigar punch 10 includes a cylindrical piston 11, a casing 12, a spring 13, and a wall 14. The cylindrical piston 11 has a first end and a second end that has a taper. A tip of the second end of the cylindrical piston 11 with a taper helps to align the cut in an end of a cigar. The casing 12 further includes a first cylindrical shaped portion 15, a tapered cylindrical shaped portion 16, and a second cylindrical shaped portion 17. The first cylindrical shaped portion 15 has a first opening with a cutting edge 20 and the cutting edge 20 is adapted to make a cylindrical cut in the first end of a cigar. A first end of the tapered cylindrical shaped portion 16 is attached to an end of the first cylindrical shaped portion 15 and away from the first opening of the first cylindrical shaped portion 15.

The cylindrical piston 11 is inserted into casing 12 by placing the first end of cylindrical piston 11 through the first opening of the first cylindrical shaped portion 15. The cylindrical piston 11 is attached to the casing 12 through a spring 13. The spring 13 has a first end and a second end. The first end of spring 13 is soldered to the first end of cylindrical piston 11, while the second end of spring 13 is soldered to the wall 14 of casing 12. Wall 14 is a portion of casing 12, which lies at a transverse angle relative to the length of casing 12 and closes off the second cylindrical shaped portion 17, at the side away from the tapered cylindrical shaped portion 16. A person of ordinary skill in the art will appreciate that soldering is not the only means of attaching spring 13 to cylindrical piston 11 and wall 14, and that any other means of permanent attachment may be used.

Figure 2:
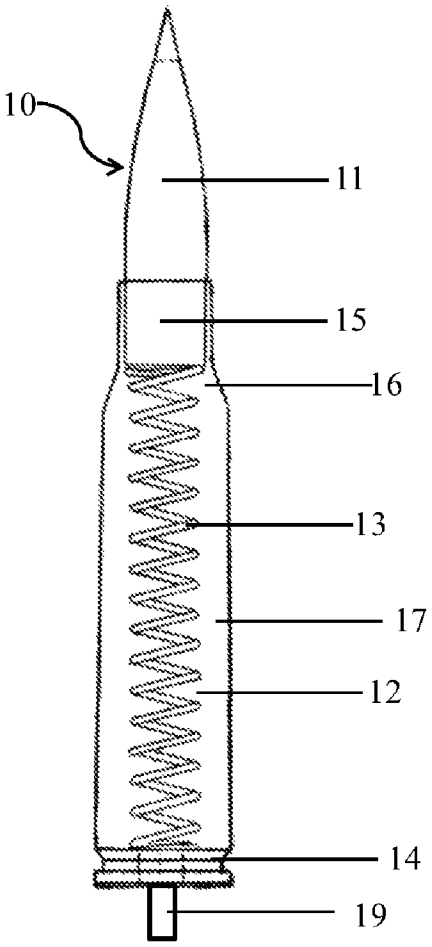
FIG. 2 is a simplified view of another embodiment of a self-cleaning cigar punch in accordance with the present invention illustrating a key chain affixed to a wall of a casing.

FIG. 2 is a simplified view of another embodiment of a self-cleaning cigar punch in accordance with the present invention illustrating a key chain affixed to a wall of a casing. The key chain 19 is affixed to a wall 14 of a casing 12.

Figure 3:
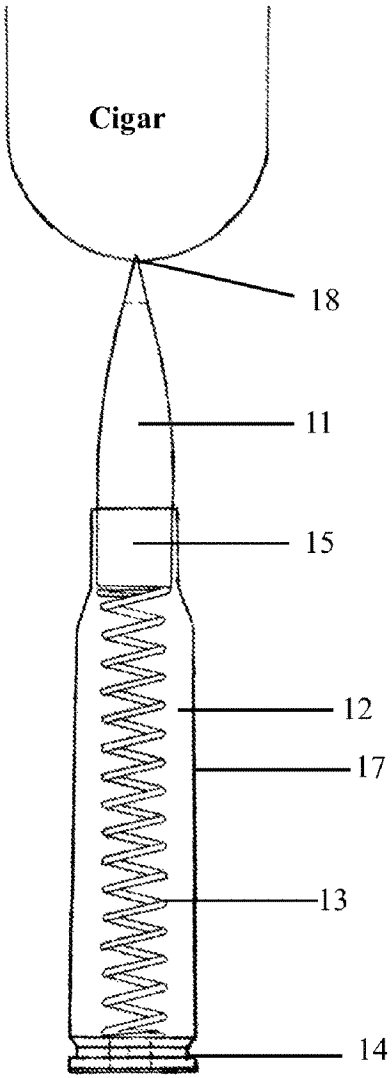
FIG. 3 is a detailed view of a cigar punch in accordance with the present invention, before the pressure is applied.

FIG. 3 shows a detailed view of a cigar punch in accordance with the present invention, before applying it to a cigar. In a resting state, at least part of cylindrical piston 11 should lie outside casing 12, with the tip of the second end with a taper facing away from the first cylindrical portion 15.

It is appreciated that the cigar punch and its components can be of varying sizes in order to accommodate varying cigar sizes. In an exemplary embodiment, the cigar punch is made to resemble a .308 caliber bullet. Here, the casing 12 has a length of between about 2.00 and 2.03 inches, a second cylindrical shaped portion 17 with a diameter between about 0.460 and 0.485 inches, and a first cylindrical shaped portion 15 with a diameter between about 0.33 and 0.36 inches. The spring 13 has a length of between about 1.45 and 1.55 inches and a diameter of between about 0.30 and 0.33 inches. The cylindrical piston 11 has a length of between about 0.70 and 0.80 inches and a diameter of the first end of between about 0.29 and 0.32 inches.

It is appreciated that the cigar punch and its components can be of varying materials. In an exemplary embodiment, the cigar punch and all its components are made of metal. However, other materials (such as plastic) are contemplated. The cutting edge 20 of first cylindrical opening 15 needs to be of a material that is sturdy and sharp enough to cut into a first end of a cigar 18 when applied with an effective amount of force by a person.

Referencing FIG. 3, the present invention is designed to operate by first lining up the tip of the second end with a taper of cylindrical piston 11 with the approximate center of the first end of a cigar 18. Once this is accomplished, the user presses the cigar punch into the first end of a cigar 18 by applying a sufficient amount of force against wall 14, angling the force towards the first end of a cigar 18. This force causes spring 13 to compress. When spring 13 compresses, cylindrical piston 11 further recedes within casing 12. As cylindrical piston 12 recedes, the cutting edge 20 of cylindrical opening 15 is brought into contact with the first end of a cigar 18. A further application of force causes the cutting edge 20 of cylindrical opening 15 to cut into the cigar, thus cutting a hole into the cigar.

Figure 4:
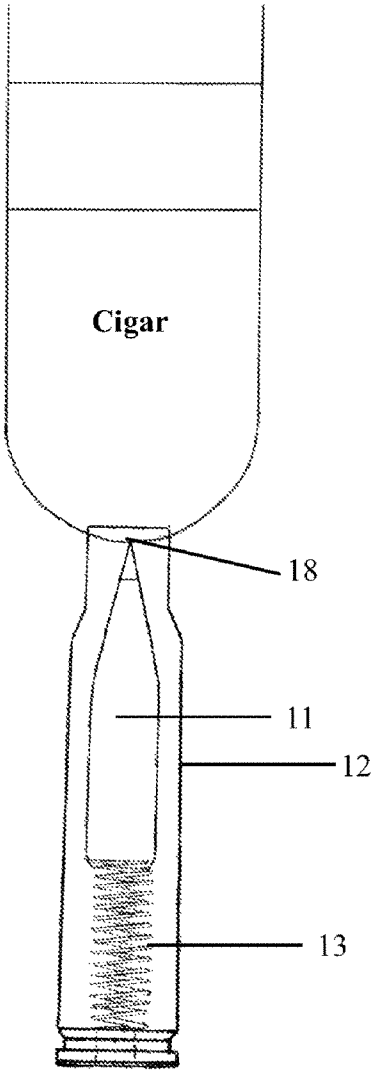
FIG. 4 is a detailed view of a cigar punch in accordance with the present invention after the pressure is applied.

FIG. 4 shows the configuration of the cigar punch once a user has pressed the cigar punch into a cigar and cut a hole into the first end of a cigar 18.

When the user has cut a sufficient amount of the first end of a cigar 18, the user pulls the cigar punch away from the cigar. This causes spring 13 to decompress, which in turn causes cylindrical piston 11 to emerge from within casing 12 and return to a resting state. In an exemplary embodiment, the portion of the first end of a cigar 18 that was cut out by the aforementioned pressure application should still be attached to the tip of cylindrical piston 11. This cigar portion can be removed for easy cleaning.

Figure 5:
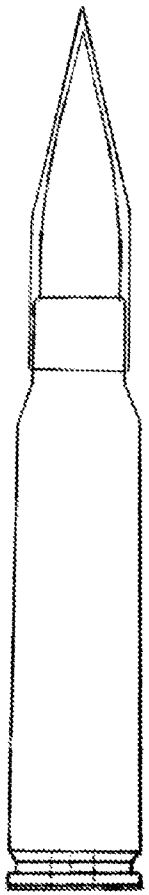
FIG. 5 is a simplified view of another embodiment of a self-cleaning cigar punch in accordance with the present invention illustrating a cover to prevent the cutting edge to be exposed.

FIG. 5 shows the cigar punch with a cover. The cover is designed to protect the cutting edge of the cigar punch. The cover has a cover body and a first opening which is large enough to fit over the cigar punch. The cover is meant to be secured to the cigar punch in a non-permanent fashion, such that the cover can be later removed manually and without the assistance of mechanical devices. The cover is releasably secured to the cigar punch by inserting the second end of cylindrical piston 11 through the first opening of the cover. It can be further secured through a frictional engagement, a latching mechanism, or a twist and lock mechanism.

It will be appreciated that the cover can be of any shape, including, for example, an elephant, the empire state building, and an effigy of the late chairman mao. It will also be appreciated that the cover can be made of plastic, metal, or any combination of such materials.

As will be appreciated, the cigar punch and/or particular components of the cigar punch can be produced in a variety of colors or with other customizations including printed graphics or the like.

What is claimed is:

1. An automatic self-cleaning cigar punch comprising:

a casing having a first cylindrical shaped portion and a wall, said first cylindrical shaped portion having a first opening opposite said wall, said first opening having a cutting edge, said cutting edge adapted to make a cylindrical cut in a first end of a cigar; and a spring having a first end attached to said wall and a second end secured to a first end of a cylindrical piston, wherein said cylindrical piston has a second end having a taper, wherein the first cylindrical shaped portion of said cigar punch further comprises a tapered cylindrical shaped portion, and a first end of said tapered cylindrical shaped portion is attached to an end of said first cylindrical shaped portion away from said first opening, whereby pushing a material that can be cut against said first opening makes said cylindrical cut in said material, and if said material within said cylindrical cut is left within said first opening when the pushing pressure is released, said cylindrical piston will expel said material remaining within said first opening.

2. The cigar punch of claim 1, further comprising a second cylindrical shaped portion, wherein a first end of said second cylindrical shaped portion is attached to a second end of said tapered cylindrical shaped portion and a second end of said second cylindrical shaped portion is attached to said wall.

3. The cigar punch of claim 1, wherein said casing has a length of between about 2.00 and 2.03 inches, an outer diameter of between about 0.460 and 0.485 inches, and a diameter of said first opening of between about 0.33 and 0.36 inches.

4. The cigar punch of claim 1, wherein said spring has a length of between about 1.45 and 1.55 inches and a diameter of between 0.30 and 0.33 inches.

5. The cigar punch of claim 1, wherein said cylindrical piston has a length of between 0.70 and 0.80 inches and a diameter of between 0.29 and 0.32 inches.

6. The cigar punch of claim 1, wherein said casing is made of a metal.

7. The cigar punch of claim 1, wherein said spring is made of a metal.

8. The cigar punch of claim 7, wherein said first end of said spring is soldered to said wall of said casing.

9. The cigar punch of claim 1, wherein said first end of said spring is soldered to said wall of said casing.

10. The cigar punch of claim 1, wherein said second end of said spring is soldered to said first end of said cylindrical piston.

11. The cigar punch of claim 7, wherein said second end of said spring is soldered to said first end of said cylindrical piston.

12. The cigar punch of claim 1, wherein said spring compresses within said casing upon pressure.

13. The cigar punch of claim 1, wherein said cylindrical piston slides down within said casing under pressure.

14. The cigar punch of claim 1, wherein said wall of said casing is affixed with a key chain.

15. The cigar punch of claim 1, further comprising a cover comprising a cover body and a first opening, wherein said cover is releasably secured to said cigar punch by inserting said cigar punch into said first opening of said cover in a non-permanent fashion, and wherein inserting said cigar punch into said cover results in said cover covering said cutting edge of said cigar punch.

16. The cigar punch claim 15, wherein said cover is of any shape.

17. The cigar punch claim 15, wherein said cover is made of plastic, metal, or any combination thereof.

18. The cigar punch of claim 1, wherein the cigar punch is made to resemble a bullet.

19. The cigar punch of claim 18, wherein the bullet resembles a .308 caliber bullet.

* * * * *